US008919557B2

(12) United States Patent
Spivey, Sr.

(10) Patent No.: US 8,919,557 B2
(45) **Date of Patent: *Dec. 30, 2014**

(54) CARTON WITH INSERT

(71) Applicant: Graphic Packaging International, Inc., Atlanta, GA (US)

(72) Inventor: Raymond R. Spivey, Sr., Mableton, GA (US)

(73) Assignee: Graphic Packaging International, Inc., Atlanta, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/711,975

(22) Filed: Dec. 12, 2012

(65) Prior Publication Data

US 2013/0119122 A1 May 16, 2013

Related U.S. Application Data

(63) Continuation of application No. 13/234,421, filed on Sep. 16, 2011, now Pat. No. 8,356,743.

(60) Provisional application No. 61/403,528, filed on Sep. 17, 2010.

(51) Int. Cl.

| | |
|---|---|
| ***B65D 75/00*** | (2006.01) |
| ***B65D 5/46*** | (2006.01) |
| ***B65D 1/22*** | (2006.01) |
| ***B65D 71/36*** | (2006.01) |
| ***B31B 7/26*** | (2006.01) |

(52) U.S. Cl.

CPC *B65D 1/22* (2013.01); *B65D 71/36* (2013.01); *B31B 7/26* (2013.01); *B65D 2571/00141* (2013.01); *B65D 2571/0045* (2013.01); *B65D 2571/0053* (2013.01); *B65D 2571/00574* (2013.01); *B65D 2571/00592* (2013.01); *B65D 2571/0066* (2013.01); *B65D 2571/00728* (2013.01); *B65D 2571/00814* (2013.01)

USPC ..... 206/427; 229/117.16; 229/199; 229/244; 493/89

(58) Field of Classification Search

USPC ..... 206/167, 170, 427, 433; 53/452, 456, 53/467, 468, 473, 476; 229/117.13, 229/117.16, 117.17, 122.32, 143, 199, 240, 229/242, 244; 493/84, 86, 88, 89, 122, 128, 493/136, 162

See application file for complete search history.

(56) References Cited

U.S. PATENT DOCUMENTS

| | | | |
|---|---|---|---|
| 1,925,102 | A | 9/1933 | Levkoff |
| 2,005,924 | A | 6/1935 | Wilson |

(Continued)

FOREIGN PATENT DOCUMENTS

| | | |
|---|---|---|
| CA | 873185 | 6/1971 |
| CA | 2 610 666 | 5/2008 |

(Continued)

OTHER PUBLICATIONS

International Search Report and Written Opinion from PCT/US2011/055233 dated May 17, 2012.

(Continued)

*Primary Examiner* — Luan K Bui

(74) *Attorney, Agent, or Firm* — Womble Carlyle Sandridge & Rice, LLP

(57) ABSTRACT

A carton can comprise a plurality of panels that extends at least partially around an interior of the carton and comprises a top panel, a bottom panel, a first side panel, and a second side panel. A plurality of end flaps are respectively foldably connected to respective panels of the plurality of panels and at least partially form a closed end of the carton. The plurality of end flaps can comprise a top end flap foldably connected to the top panel. A reinforcing insert can comprise a central panel, a reinforcing end flap, and a reinforcing side flap. The central panel at least partially overlaps the top panel, the reinforcing side flap is foldably connected to the central panel, and the reinforcing end flap comprises a proximal portion foldably, an intermediate portion, and a distal portion. The distal at least partially overlaps the top end flap.

29 Claims, 9 Drawing Sheets

(56) References Cited

U.S. PATENT DOCUMENTS 2,067,749 A 1/1937 Zimmerman et al.
2,115,673 A 4/1938 Stompe
2,196,502 A 4/1940 Kells
2,299,027 A 10/1942 Novak
2,386,905 A 10/1945 Meitzen
2,648,484 A 8/1953 Belsinger
2,669,351 A 2/1954 Carson et al.
2,754,047 A 7/1956 Schmidt et al.
3,078,032 A 2/1963 Robinson et al.
3,128,010 A 4/1964 Forrer
3,133,634 A 5/1964 Bozdar
3,173,596 A 3/1965 Aust et al.
3,178,242 A 4/1965 Ellis et al.
3,228,582 A 1/1966 Osberg
3,263,861 A 8/1966 Carr
3,265,283 A 8/1966 Farquhar
3,300,115 A 1/1967 Schauer
3,332,594 A 7/1967 De Capua
3,346,167 A 10/1967 Schmidt
3,356,279 A 12/1967 Root
3,517,858 A 6/1970 Farquhar
3,533,549 A 10/1970 Gilchrist
3,540,581 A 11/1970 Koolnis
3,825,170 A 7/1974 Aust et al.
3,904,036 A 9/1975 Forrer
4,155,449 A 5/1979 Bryne
4,214,660 A 7/1980 Hunt, Jr.
4,222,485 A 9/1980 Focke
4,256,226 A 3/1981 Stone
4,318,474 A 3/1982 Hasegawa
4,364,509 A 12/1982 Holley, Jr. et al.
4,375,258 A 3/1983 Crayne et al.
4,376,509 A 3/1983 Schaffer
4,378,877 A 4/1983 Botterman et al.
4,396,143 A 8/1983 Killy
4,417,655 A 11/1983 Forbes, Jr.
4,417,661 A 11/1983 Roccaforte
4,538,759 A 9/1985 Dutcher
4,577,762 A 3/1986 Kuchenbecker
4,588,084 A 5/1986 Holley, Jr.
4,605,128 A 8/1986 Rieke
4,621,766 A 11/1986 McClure
4,658,984 A 4/1987 Brunner
4,757,938 A 7/1988 Collins
4,817,866 A 4/1989 Wonnacott
4,830,267 A 5/1989 Wilson
4,890,440 A 1/1990 Romagnoli
4,949,845 A 8/1990 Dixon
4,967,901 A 11/1990 Wood
4,974,771 A 12/1990 Lavery
5,072,876 A 12/1991 Wilson
5,101,642 A 4/1992 Alexandrov
5,119,985 A 6/1992 Dawson et al.
5,137,211 A 8/1992 Summer et al.
5,219,229 A 6/1993 Sengewald
5,249,681 A 10/1993 Miller
5,297,725 A 3/1994 Sutherland
5,320,277 A 6/1994 Stout et al.
5,333,734 A 8/1994 Stout et al.
5,350,109 A 9/1994 Brown et al.
5,425,474 A 6/1995 Dalea et al.
5,482,185 A 1/1996 McNaughton
5,482,203 A 1/1996 Stout
5,505,372 A 4/1996 Edson et al.
5,577,612 A 11/1996 Chesson et al.
5,588,585 A 12/1996 McClure
5,597,114 A 1/1997 Kramedjian et al.
5,622,309 A 4/1997 Matsuda et al.
5,664,683 A 9/1997 Brody
5,690,213 A 11/1997 Matsumura
5,690,230 A 11/1997 Griffith
5,794,778 A 8/1998 Harris
5,826,783 A 10/1998 Stout
5,873,516 A * 2/1999 Boggs ..... 229/117.13
5,875,961 A 3/1999 Stone et al.
5,881,884 A 3/1999 Podosek
5,921,398 A 7/1999 Carroll
5,924,559 A 7/1999 Carrel et al.
5,927,498 A 7/1999 Saam
6,050,402 A 4/2000 Walter
6,170,741 B1 * 1/2001 Skolik et al. ..... 229/117.13
6,176,419 B1 1/2001 Holley, Jr.
6,250,542 B1 6/2001 Negelen
6,283,293 B1 9/2001 Lingamfelter
6,302,320 B1 10/2001 Stout
6,409,077 B1 6/2002 Telesca et al.
D459,927 S 7/2002 Flowers et al.
6,471,120 B1 10/2002 Vogel
6,478,219 B1 11/2002 Holley, Jr.
6,484,903 B2 11/2002 Spivey et al.
6,550,615 B2 4/2003 Lingamfelter
6,557,699 B1 5/2003 Focke et al.
6,578,736 B2 6/2003 Spivey
6,604,677 B1 8/2003 Sutherland et al.
6,631,803 B2 10/2003 Rhodes et al.
6,669,083 B2 12/2003 Bates
6,715,639 B2 4/2004 Spivey
6,752,262 B1 6/2004 Boriani et al.
6,766,940 B2 7/2004 Negelen
6,789,673 B2 9/2004 Lingamfelter
6,848,573 B2 2/2005 Gould et al.
6,866,186 B2 3/2005 Fogle et al.
6,902,104 B2 6/2005 Holley, Jr. et al.
6,905,066 B2 6/2005 Holley, Jr.
6,918,487 B2 7/2005 Harrelson
6,926,193 B2 8/2005 Smalley
6,929,172 B2 8/2005 Bates et al.
6,932,265 B2 8/2005 Sax et al.
6,968,992 B2 11/2005 Schuster
6,969,172 B2 11/2005 Actis-Datta
6,974,072 B2 12/2005 Harrelson
6,991,107 B2 1/2006 Harrelson
6,997,316 B2 2/2006 Sutherland
7,000,803 B2 2/2006 Miller
7,073,665 B2 7/2006 Auclair et al.
7,104,435 B2 9/2006 Holley, Jr.
7,134,593 B2 11/2006 Harrelson
7,159,759 B2 1/2007 Sutherland et al.
7,225,930 B2 6/2007 Ford et al.
7,422,104 B2 9/2008 Perkinson
7,478,743 B2 1/2009 Holley, Jr.
7,604,157 B2 10/2009 Zammit et al.
7,699,215 B2 4/2010 Spivey, Sr.
8,356,743 B2 1/2013 Spivey, Sr.
8,387,855 B2 * 3/2013 Brand ..... 229/117.13
2002/0029991 A1 3/2002 Lingamfelter
2002/0070139 A1 6/2002 Bates
2002/0088820 A1 7/2002 Spivey
2002/0088821 A1 7/2002 Spivey et al.
2002/0185499 A1 12/2002 Harrelson et al.
2003/0006158 A1 1/2003 Skolik et al.
2003/0136820 A1 7/2003 Negelen
2003/0141313 A1 7/2003 Bates
2003/0150759 A1 8/2003 White, Jr.
2003/0192907 A1 10/2003 Bates
2004/0040334 A1 3/2004 Rusnock
2004/0060972 A1 4/2004 Harrelson
2004/0089575 A1 5/2004 Lingamfelter
2004/0089671 A1 5/2004 Miller
2004/0099558 A1 5/2004 Oliff et al.
2004/0155098 A1 8/2004 Harrelson
2004/0188277 A1 9/2004 Auclair
2004/0188300 A1 9/2004 Sutherland
2004/0188508 A1 9/2004 Holley, Jr. et al.
2005/0023170 A1 2/2005 Lingamfelter
2005/0092820 A1 5/2005 Chekroune
2005/0115843 A1 6/2005 Harrelson
2005/0126947 A1 6/2005 Holley, Jr.
2005/0167291 A1 8/2005 Sutherland
2005/0167478 A1 8/2005 Holley, Jr.
2005/0189405 A1 9/2005 Gomes et al.
2005/0263574 A1 12/2005 Schuster
2006/0054522 A1 3/2006 Kline et al.
2006/0081691 A1 4/2006 Smalley

(56) References Cited

U.S. PATENT DOCUMENTS

| | | | | |
|---|---|---|---|---|
| 2006/0091193 | A1 | 5/2006 | DeBusk | |
| 2006/0118606 | A1 | 6/2006 | Holley, Jr. et al. | |
| 2006/0131370 | A1 | 6/2006 | Bates | |
| 2006/0175386 | A1 | 8/2006 | Holley, Jr. | |
| 2006/0231441 | A1 | 10/2006 | Gomes et al. | |
| 2006/0231600 | A1 | 10/2006 | Holley, Jr. | |
| 2006/0249413 | A1 | 11/2006 | Auclair et al. | |
| 2006/0278689 | A1 | 12/2006 | Boshinski et al. | |
| 2007/0007325 | A1 | 1/2007 | Suzuki et al. | |
| 2007/0029371 | A1 | 2/2007 | Theelen | |
| 2007/0108261 | A1* | 5/2007 | Schuster | 229/117.16 |
| 2007/0131748 | A1 | 6/2007 | Brand | |
| 2007/0164093 | A1 | 7/2007 | Spivey et al. | |
| 2007/0181658 | A1 | 8/2007 | Sutherland | |
| 2007/0205255 | A1 | 9/2007 | Dunn | |
| 2007/0210144 | A1 | 9/2007 | Brand | |
| 2007/0251982 | A1 | 11/2007 | Brand | |
| 2007/0295790 | A1 | 12/2007 | Zammit et al. | |
| 2008/0023535 | A1* | 1/2008 | Holley, Jr. | 229/244 |
| 2008/0048014 | A1 | 2/2008 | Bates | |
| 2008/0128479 | A1 | 6/2008 | Bates et al. | |
| 2009/0282843 | A1 | 11/2009 | Brand | |
| 2010/0044420 | A1 | 2/2010 | Brand et al. | |
| 2010/0122999 | A1 | 5/2010 | Brand | |
| 2010/0237138 | A1 | 9/2010 | Bradford | |
| 2011/0011924 | A1 | 1/2011 | Spivey et al. | |
| 2011/0049228 | A1 | 3/2011 | Brand | |
| 2011/0068160 | A1 | 3/2011 | Brand et al. | |
| 2011/0290692 | A1 | 12/2011 | Spivey, Sr. | |

FOREIGN PATENT DOCUMENTS

| | | |
|---|---|---|
| EP | 0 066029 | 12/1982 |
| EP | 1 433 714 | 6/2004 |
| EP | 1 698 565 | 9/2006 |
| FR | 2 549 010 | 1/1985 |
| GB | 2 264 101 | 8/1993 |
| JP | 2002-128064 | 5/2002 |
| JP | 2006-111342 | 4/2006 |
| JP | 2007-055630 | 3/2007 |
| JP | 2007-532421 | 11/2007 |
| JP | 2010-149927 | 7/2010 |
| KR | 10-0154124 | 2/1999 |
| KR | 10-0371048 | 8/2003 |
| WO | WO 96/21603 | 7/1996 |
| WO | WO 96/29260 | 9/1996 |
| WO | WO 99/28198 | 6/1999 |
| WO | WO 99/64301 | 12/1999 |
| WO | WO 00/03937 | 1/2000 |
| WO | WO 02/47990 | 6/2002 |
| WO | WO 2004/043790 | 5/2004 |
| WO | WO 2005/051781 | 6/2005 |
| WO | WO 2005/100175 | 10/2005 |
| WO | WO 2006/050210 | 5/2006 |
| WO | WO 2006/050316 | 5/2006 |
| WO | WO 2007/076544 | 7/2007 |

OTHER PUBLICATIONS

Supplementary European Search Report for EP 10 75 4034 dated May 30, 2012.

International Search Report and Written Opinion from PCT/US2010/027597 dated Oct. 27, 2010.

International Search Report and Written Opinion from PCT/US2010/041971 dated Mar. 1, 2011.

International Search Report and Written Opinion from PCT/US2010/047102 dated May 30, 2011.

International Search Report and Written Opinion from PCT/US2011/037872 dated Oct. 25, 2011.

International Search Report and Written Opinion for PCT/US2011/051905 dated Apr. 23, 2012.

International Search Report and Written Opinion for PCT/US2012/026050 dated Sep. 21, 2012.

Notice of Allowance and Fee(s) Due for U.S. Appl. No. 13/234,421, dated Sep. 21, 2012.

Supplemental Notice of Allowability for U.S. Appl. No. 13/234,421 dated Nov. 6, 2012.

Part B—Fee(s) Transmittal for U.S. Appl. No. 13/234,421 dated Dec. 12, 2012.

Issue Notification for U.S. Appl. No. 13/234,421 dated Dec. 29, 2012.

Supplementary European Search Report for related European application No. EP 11 82 6010, dated Jan. 9, 2014.

* cited by examiner

CARTON WITH INSERT

CROSS-REFERENCE TO RELATED APPLICATIONS

This application is a continuation application of U.S. patent application Ser. No. 13/234,421, filed Sep. 16, 2011, now U.S. Pat. No. 8,356,743, which application claims the benefit of U.S. Provisional Patent Application No. 61/403,528, filed Sep. 17, 2010, now expired.

INCORPORATION BY REFERENCE

The disclosures of U.S. patent application Ser. No. 13/234,421, which was filed on Sep. 16, 2011, and U.S. Provisional Patent Application No. 61/403,528, which was filed on Sep. 17, 2010, are hereby incorporated by reference for all purposes as if presented herein in their entirety.

BACKGROUND OF THE DISCLOSURE

The present disclosure generally relates to cartons for holding beverage containers or other types of articles. More specifically, the present disclosure relates to cartons having a reinforcing insert.

SUMMARY OF THE DISCLOSURE

In general, one aspect of the disclosure is directed to a carton for holding a plurality of containers. The carton can comprise a plurality of panels that extends at least partially around an interior of the carton. The plurality of panels comprises a top panel, a bottom panel, a first side panel, and a second side panel. A plurality of end flaps are respectively foldably connected to respective panels of the plurality of panels. The plurality of end flaps are at least partially overlapped with respect to one another to thereby at least partially form a closed end of the carton. The plurality of end flaps can comprise a top end flap foldably connected to the top panel. A reinforcing insert can comprise a central panel, a reinforcing end flap, and a reinforcing side flap. The central panel at least partially overlaps the top panel, the reinforcing side flap is foldably connected to the central panel, and the reinforcing end flap comprises a proximal portion foldably connected to the central panel, an intermediate portion foldably connected to the proximal portion, and a distal portion foldably connected to the intermediate portion. The distal portion of the reinforcing end flap at least partially overlaps the top end flap.

In another aspect, the disclosure is generally directed to, in combination, a carton blank and a reinforcing insert for forming a carton for holding a plurality of containers. The carton blank can comprises a plurality of panels comprising a top panel, a bottom panel, a first side panel, and a second side panel. The carton blank can further comprise a plurality of end flaps respectively foldably connected to respective panels of the plurality of panels for at least partially overlapping with respect to one another to at least partially close an end of the carton formed from the carton blank. The plurality of end flaps comprises a top end flap foldably connected to the top panel. The reinforcing insert can comprise a central panel at least partially overlapping the top panel, a reinforcing end flap comprising a proximal portion foldably connected to the central panel, an intermediate portion foldably connected to the proximal portion, and a distal portion foldably connected to the intermediate portion. The distal portion of the reinforcing end flap at least partially overlaps the top end flap. The reinforcing insert can further comprise a reinforcing side flap foldably connected to the central panel.

In another aspect, the disclosure is generally directed to a method of forming a carton. The method comprises obtaining a carton blank comprising a plurality of panels comprising a top panel, a bottom panel, a first side panel, and a second side panel. A plurality of end flaps can be respectively foldably connected to respective panels of the plurality of panels. The plurality of end flaps can comprise a top end flap foldably connected to the top panel. The method can further comprise obtaining a reinforcing insert comprising a central panel, a reinforcing end flap, and a reinforcing side flap foldably connected to the central panel. The reinforcing end flap comprises a proximal foldably connected to the central panel, an intermediate portion foldably connected to the proximal portion, and a distal portion foldably connected to the intermediate portion. The method also can comprise positioning the reinforcing insert relative to the carton blank so that the central panel at least partially overlaps the top panel and the distal portion of the reinforcing insert at least partially overlaps the top end flap, and forming an interior of the carton at least partially defined by the plurality of panels. The forming the interior of the carton can comprise forming an open-ended sleeve. The method further can comprise positioning the plurality of end flaps and the reinforcing end flap to at least partially close an end of the open-ended sleeve.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION OF THE EXEMPLARY EMBODIMENTS

The present disclosure generally relates to cartons that contain articles such as containers, bottles, cans, etc. The articles can be used for packaging food and beverage products, for example. The articles can be made from materials suitable in composition for packaging the particular food or beverage item, and the materials include, but are not limited to, aluminum and/or other metals; glass; plastics such as PET, LDPE, LLDPE, HDPE, PP, PS, PVC, EVOH, and Nylon; and the like, or any combination thereof.

Cartons according to the present disclosure can accommodate articles of any shape. For the purpose of illustration and not for the purpose of limiting the scope of the disclosure, the following detailed description describes beverage containers (e.g., glass beverage bottles) as disposed within the carton embodiments. In this specification, the terms "lower," "bottom," "upper" and "top" indicate orientations determined in relation to fully erected and upright cartons.

Figure 1:
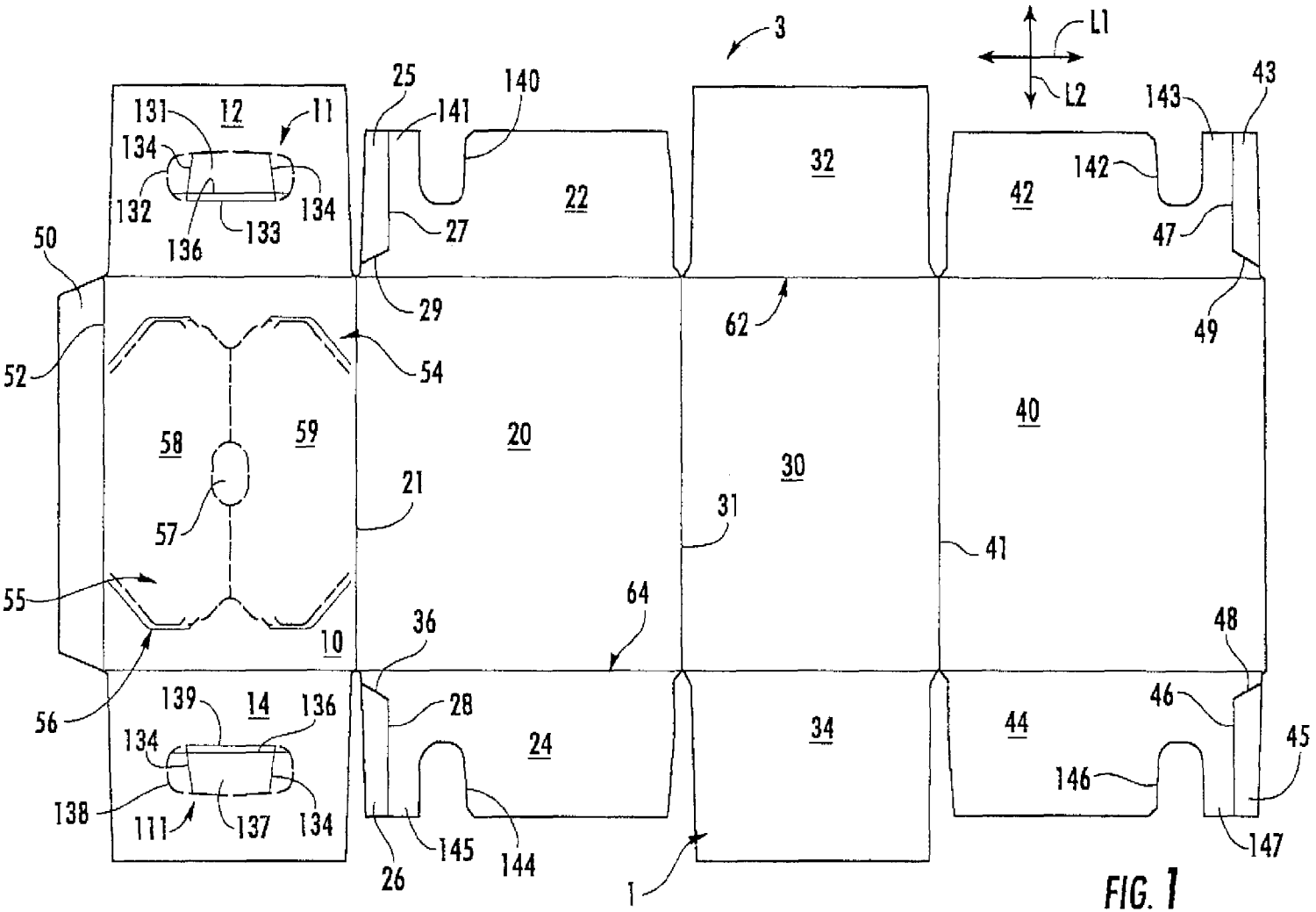
FIG. 1 is an interior plan view of a carton blank used to form a carton according to an exemplary embodiment of the disclosure.
Figure 3:
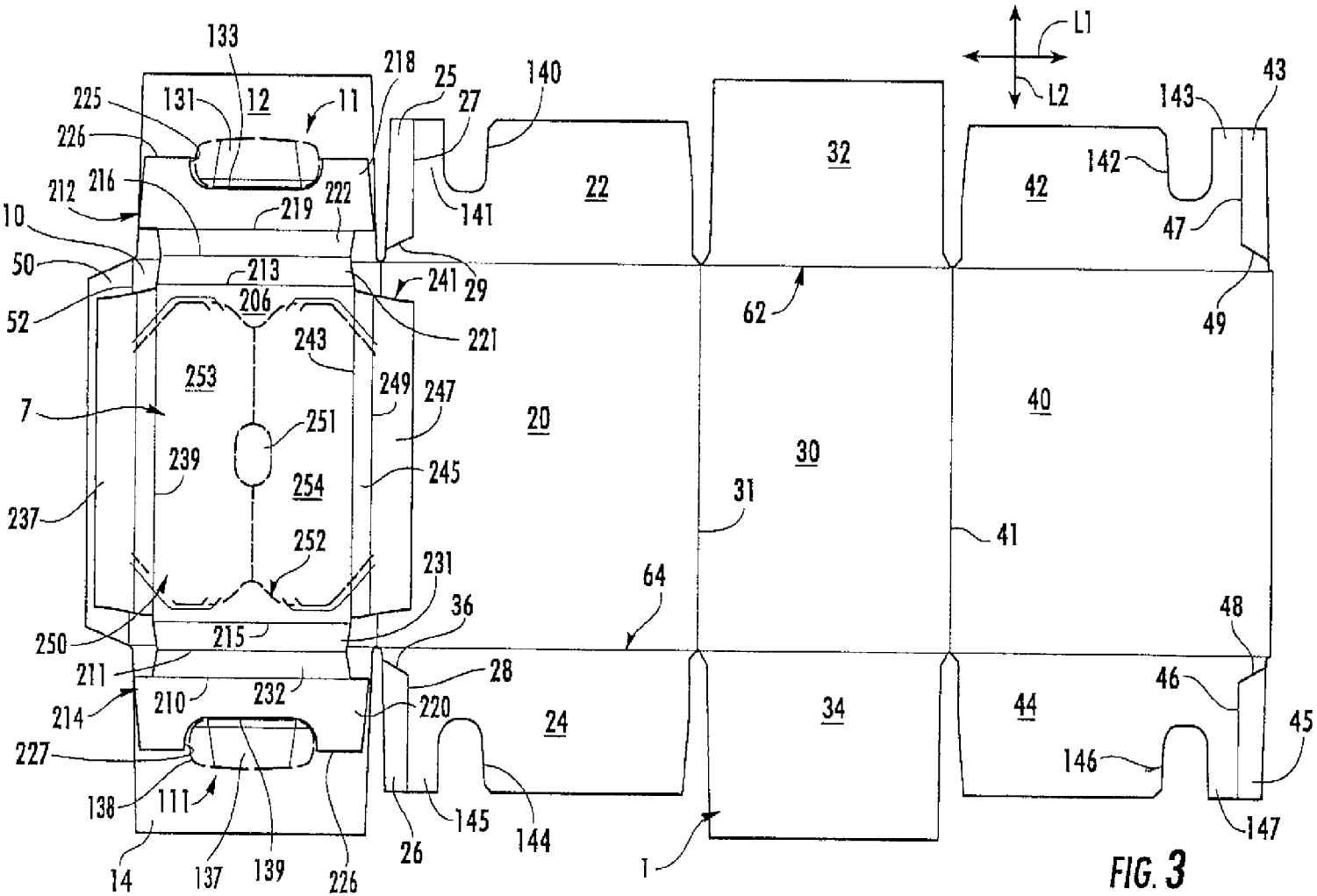
FIG. 3 an interior plan view of the reinforcing insert blank of FIG. 2 overlaid on the carton blank of FIG. 1.
Figure 4:
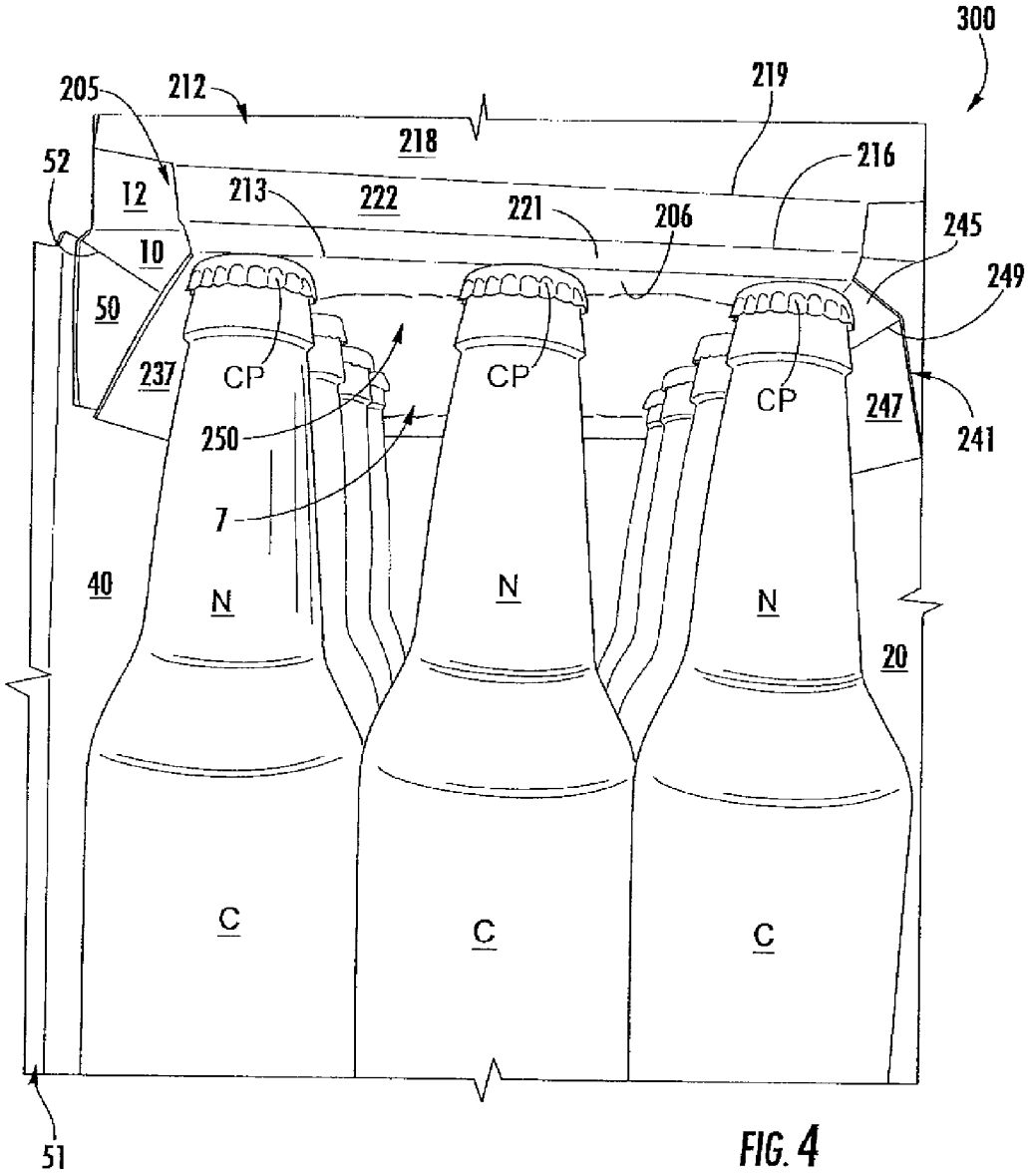
FIG. 4 is a perspective view showing the partially-erected carton in the form of an open-ended sleeve according to the exemplary embodiment of the disclosure.

FIG. 1 is a plan view of the interior side 1 of a blank, generally indicated at 3, used to form a carton 5 (FIG. 8) according to the exemplary embodiment of the disclosure. The carton 5 can be used to house a plurality of articles such as containers C with necks or upper portions N that are generally narrower than the lower portions of the containers (FIG. 4). In the illustrated embodiment, the carton 5 is sized to house twelve containers C in a single layer in a 3×4 arrangement, but it is understood that the carton 5 may be sized and shaped to hold containers of a different or same quantity in more than one layer and/or in different row/column arrangements (e.g., 1×6, 3×6, 2×6×2, 3×5, 4×5, 2×9, 2×6, 3×4, etc.). The carton 5 has a dispenser 7 (FIGS. 3 and 8) formed in the carton for allowing access to the containers C. In the illustrated embodiment, the carton 5 includes a first handle, generally indicated at 11 (FIG. 8) for grasping and carrying the carton at a first end 51 of the carton, and a second handle, generally indicated at 111 (FIG. 6B), for grasping and carrying the carton at a second end 53 of the carton. As will be discussed below in more detail, the handles 11, 111 are formed from various features in the blank 3.

The carton blank 3 has a longitudinal axis L1 and a lateral axis L2. In the illustrated embodiment, the blank 3 comprises a top panel 10 foldably connected to a first side panel 20 at a first lateral fold line 21. A bottom panel 30 is foldably connected to the first side panel 20 at a second lateral fold line 31. A second side panel 40 is foldably connected to the bottom panel 30 at a third lateral fold line 41. In the illustrated embodiment, the blank 3 includes an attachment flap 50 foldably connected to the top panel 10 at a fourth lateral fold line 52. Any of the top and bottom panels 10, 30 and the first and second side panels 20, 40 can be otherwise shaped, arranged, configured, or omitted, without departing from the disclosure. For example, the blank 3 can alternatively include two top panels cooperating to form a top of the carton 5 or two bottom panels cooperating to form a bottom of the carton. Additionally, the attachment flap 50 could be foldably connected to the second side panel 40 in an alternative embodiment.

The top panel 10 is foldably connected to a first top end flap 12 and a second top end flap 14. The first side panel 20 is foldably connected to a first side end flap 22 and a second side end flap 24. The bottom panel 30 is foldably connected to a first bottom end flap 32 and a second bottom end flap 34. The second side panel 40 is foldably connected to a first side end flap 42 and a second side end flap 44. When the carton 5 is erected, the top and bottom end flaps 12 and 32 and side end flaps 22 and 42 close the first end 51 (FIG. 8) of the carton, and the top and bottom end flaps 14 and 34 and side end flaps 24 and 44 close the second end 53 (FIG. 6B) of the carton. In accordance with an alternative embodiment of the present disclosure, different flap arrangements can be used for at least partially closing the ends 51, 53 of the carton 5.

In one embodiment, the top and bottom end flaps 12 and 32 and side end flaps 22 and 42 extend along a first marginal area of the blank 3, and are foldably connected at a first longitudinal fold line 62 that extends along the length of the blank. In the illustrated embodiment, the top and bottom end flaps 14 and 34 and side end flaps 24 and 44 extend along a second marginal area of the blank 3, and are foldably connected at a second longitudinal fold line 64 that also extends along the length of the blank. The longitudinal fold lines 62, 64 may be, for example, substantially straight, or offset at one or more locations to account for blank thickness or for other factors.

In one embodiment, the side end flaps 22, 24 each include a compression tab 25, 26 respectively foldably connected thereto at a lateral fold line 27, 28 respectively. In the illustrated embodiment, the compression tabs 25, 26 are at least partially defined by oblique cut lines 29, 36 extending from fold lines 27, 28 to a respective top edge of the side end flaps 22, 24. Similarly, side end flaps 42, 44 each include compression tabs 43, 45 foldably connected thereto at lateral fold lines 47, 46 respectively, and being at least partially defined by oblique cut lines 49, 48, in a respective side end flap 42, 44, respectively, extending therefrom. Alternatively, the oblique cut lines 29, 36, 48, 49 could be otherwise shaped, arranged, and/or configured. Also, the oblique cut lines 29, 36, 48, 49 could be tear lines or other lines of weakening without departing from this disclosure.

According to the illustrated embodiment, the dispenser 7 comprises a dispenser pattern 54 including a dispenser panel 55 and a tear line 56 in at least the top panel 10. The dispenser panel 55 is separable from the top panel along the tear line 56 to form a dispenser opening (not shown) to provide access to the containers C within the carton. The tear line 56 forms first and second portions 58, 59 and an access panel 57 located at approximately the center of the top panel 10. The access panel 57 is removable to create an access opening capable of receiving a hand, fingers, or other apparatus to provide access to the dispenser portions 58, 59.

As shown in FIG. 1, the features that form the first handle 11 of the carton 5 include an elongate handle flap 131 formed in the top end flap 12 and foldably attached to the top end flap at a longitudinal fold line 133. The handle flap 131 is separable from the top end flap 12 along a cut or tear line 132. In the illustrated embodiment, the features of handle 11 include oblique fold lines 134 extending across the handle flap 131 and a longitudinal fold line 136 extending across the handle flap. The features that form the handle 11 further include cutouts 140, 142 in the respective side end flaps 22, 42. The side end flaps 22, 42 can also include respective upper portions 141, 143 disposed above the respective cutouts 140, 142. In the illustrated embodiment, the second handle 111 is formed from features that are substantially similar to the features that form the first handle 11. For example, the second handle 111 includes an elongate handle flap 137 foldably connected to the top end flap 14 at a longitudinal fold line 139 and is separable from the top end flap 14 along a cut or tear line 138. The second handle 111 includes oblique fold lines 134 extending across the handle flap 137 and a longitudinal fold line 136 extending across the handle flap. The features that form the handle 111 further include cutouts 144, 146 in the respective side end flaps 22, 42. The side end flaps 24, 44 can also include respective upper portions 145, 147 disposed above the respective cutouts 144, 146. The second handle 111 could have different features than the first handle without departing from the disclosure. Further, the second handle 111 can be omitted without departing from the disclosure. One or both of the first handle 11 and the second handle 111 could be otherwise shaped, arranged, configured, or omitted, without departing from the disclosure.

Figure 2:
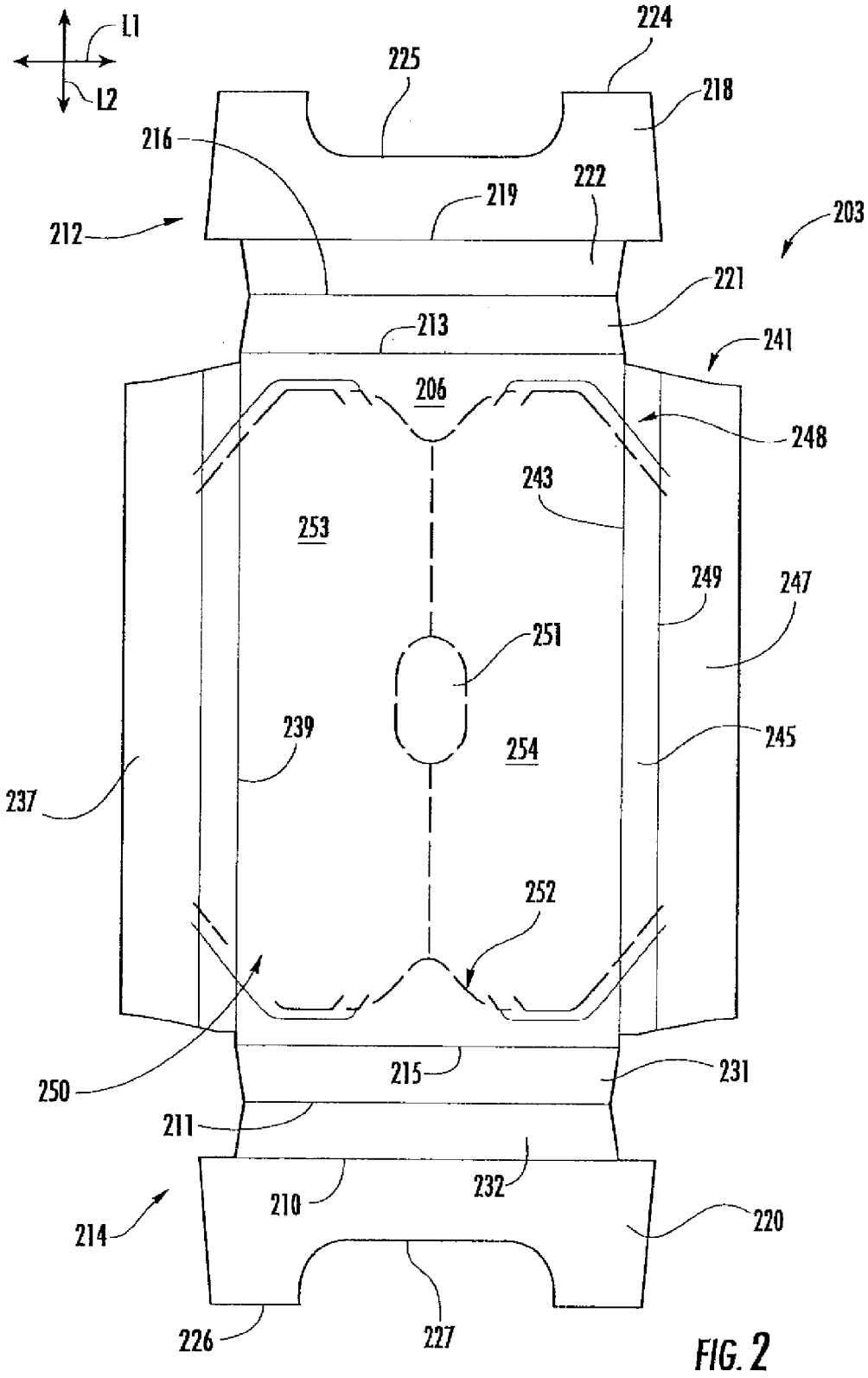
FIG. 2 is an interior plan view of a reinforcing insert blank used to form a reinforcing insert in the carton according to the exemplary embodiment of the disclosure.

FIG. 2 illustrates an interior surface of a reinforcing insert blank 203 used to form a reinforcing insert 205 (FIGS. 6A and 6B) for use in the carton 5. As illustrated in FIGS. 2 and 3, the longitudinal axis L1 and the lateral axis L2 of the reinforcing insert blank 203 are oriented so that the longitudinal axis L1 and the lateral axis L2 of the insert blank 203 comport with the respective longitudinal axis L1 and lateral axis L2 of the carton blank 3 established in FIG. 1. In the illustrated embodiment, the insert blank 203 includes a central panel 206 and two reinforcing end flaps 212, 214 respectively foldably connected to the central panel 206 at opposite ends of the central panel. A first fold line 213 connects the first reinforcing end flap 212 at the first end of the insert blank 203. A second fold line 215 connects the second reinforcing end flap 214 to the central panel 206 at the second end of the insert blank 203. The first reinforcing end flap 212 includes a first or proximal portion 221 foldably connected to the central panel 206 at fold line 213, a second or intermediate portion 222 foldably connected to the proximal portion 221 at a second fold line 216, and a third or distal portion 218 foldably connected to the intermediate portion 222 at a third fold line 219. The distal portion 218 comprises a free edge 224 that includes a U-shaped notch 225. The second reinforcing end flap 214 is similarly shaped as the first end flap 212 having a first or proximal portion 231 foldably connected to the central panel 206 at fold line 215, a second or intermediate portion 232 foldably connected to the proximal portion 231 at a fold line 211, and a third or distal portion 220 foldably connected to the intermediate portion 232 at a fold line 210. The distal portion 220 comprises a free edge 226 that includes a generally U-shaped notch 227.

In the illustrated embodiment, the insert blank 203 includes a first side flap 237 foldably connected to the central panel 206 at a lateral fold line 239 and a second side flap 241 foldably connected to the central panel 206 at a lateral fold line 243. In one embodiment, the second side flap 241 comprises a first portion 245 that is foldably connected to the central panel 206 at the fold line 243, a second portion 247 foldably connected to the first portion 245 at a lateral fold line 249. Each of the first portion 245 and second portion 247, are each independently positionable at respective fold lines 243, 249.

As shown in FIG. 2, the insert blank 203 can include an insert dispenser pattern 248 including an insert dispenser panel 250 at least partially defined by tear line 252. The insert dispenser panel 250 is configured to be aligned with the detachable dispenser panel 55 of the top panel 10 of the blank 3. The insert dispenser panel 250 includes first and second portions 253, 254 and access port 251 that are at least partially defined by the tear line 252 in the insert blank 205. The first portion 253 is sized to generally correspond to the size of first portion 58 of the dispenser panel 55, the second portion 254 is sized to correspond to the size of the second portion 59 of the dispenser panel 55, and the access port 251 is sized to correspond to the size of the access panel 57. In the illustrated, embodiment the tear line extends at least partially into the respective reinforcing side flaps 237, 241.

As shown in FIG. 3, in one exemplary embodiment, the carton 5 can be assembled by initially adhering the insert blank 203 to the top panel 10 of the carton blank 3. The insert blank 203 is positioned on the carton blank 3 so that the central panel 206 is in generally face-to-face contact with the top panel 10. In one embodiment, the exterior surface of the insert blank 203 is in contact with the interior surface 1 of the carton blank 3. The insert blank 203 is sized so that the fold lines 216, 211 connecting the proximal portions 221, 231 and intermediate portions 222, 232 of the respective reinforcing end flaps 212, 214 are generally aligned with and overlay fold lines 62, 64 connecting the top end flaps 12, 14 to respective ends of the top panel 10. The insert blank 203 is positioned relative to the top panel 10 so that the U-shaped notch 225 is adjacent and generally frames the handle flap 131 of the first handle 11. Similarly, the U-shaped notch 227 is adjacent and generally frames the handle flap 137 of the second handle 111. The central panel 206 of the insert blank 203 can be at least partially adhesively secured to the top panel 10 of the carton blank 3. In one embodiment, the first and second portions 253, 254 of the dispenser panel 250 in the central panel 206 can be glued to the respective first and second portions 58, 59 of the dispenser panel 55 in the top panel 10. Additionally, the distal portions 218, 220 can be glued to the respective top end flaps 12, 14 in an exemplary embodiment.

In accordance with the exemplary embodiment, the carton blank 3 with insert blank 203 can be further erected into the carton 5 by folding along fold lines 21, 31, 41, and 52 and adhering the attachment flap 50 to the second side panel 40 to form an open-ended sleeve 300 (FIG. 4). As shown in FIG. 4, containers C can be loaded into the open-ended sleeve 300. The carton blank 3 may be otherwise configured to have multiple top panels, multiple bottom panels, multiple side panels, or combinations thereof without departing from the scope of this disclosure.

Figure 5:
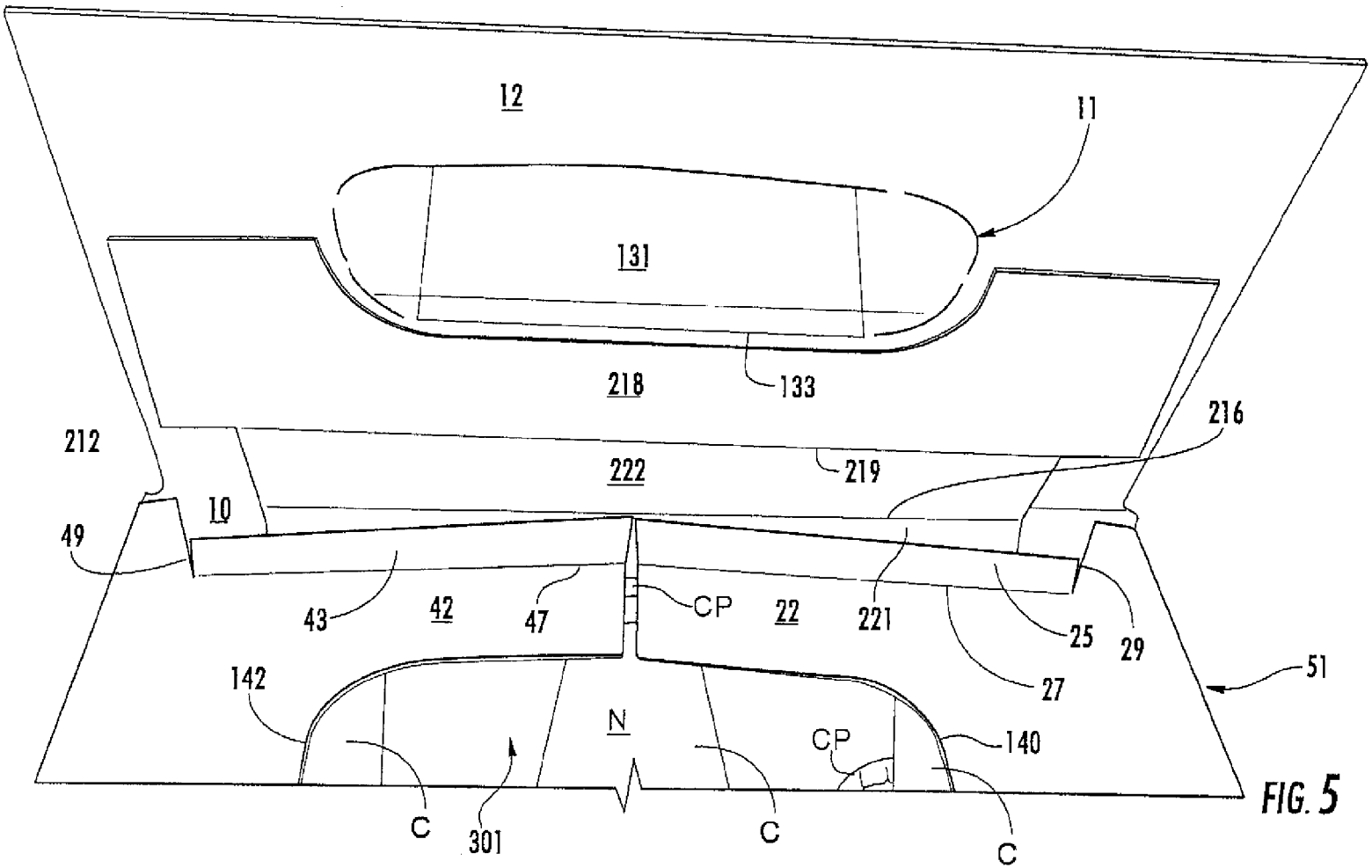
FIG. 5 is an exterior perspective view of a partially-closed end of the open-ended sleeve of FIG. 4.
Figure 7:
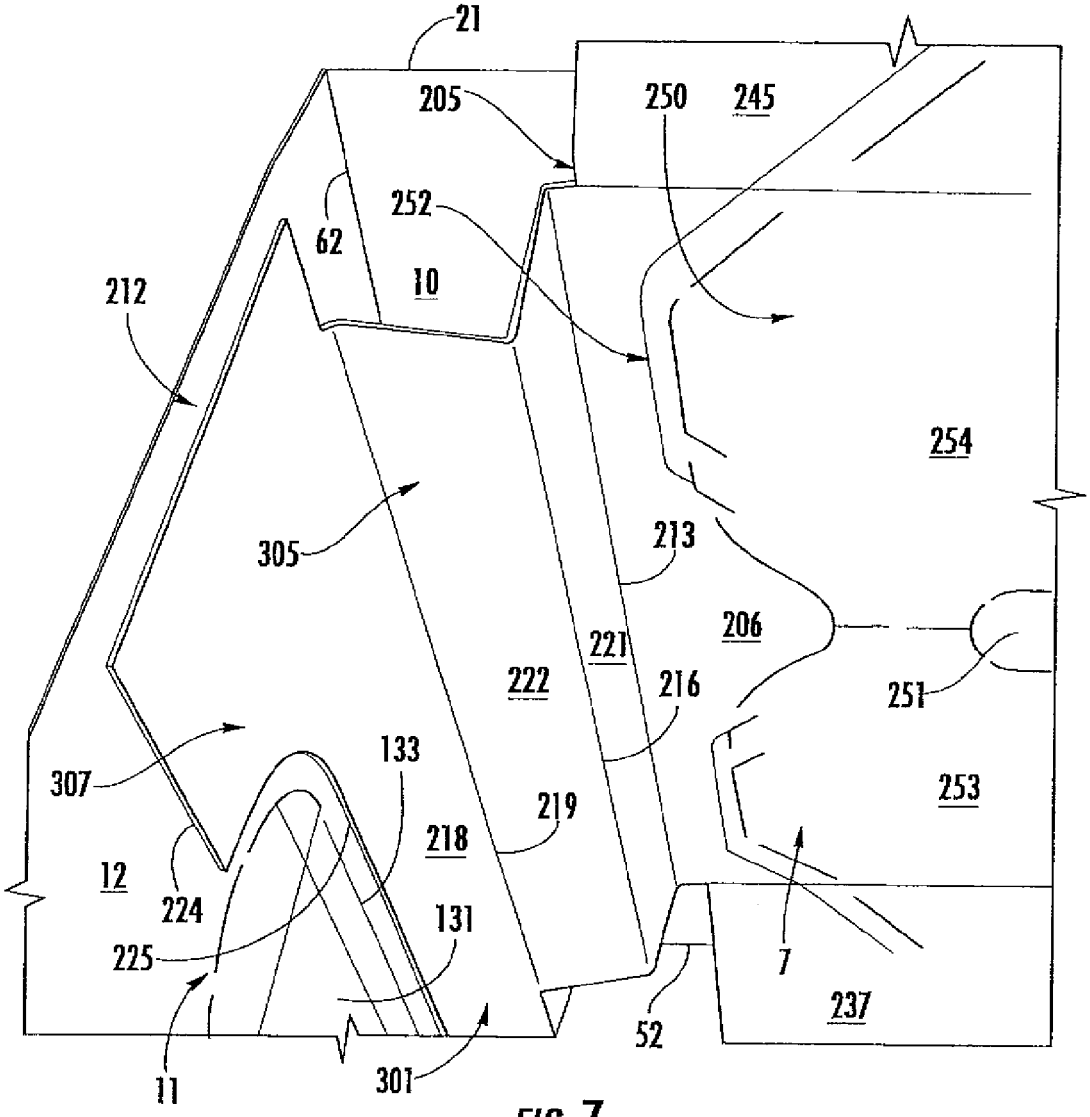
FIG. 7 is a perspective view showing an end of the reinforcing insert in the carton with the side panels and side end flaps of the carton omitted from the figure.

As shown in FIG. 5, the side end flaps 22, 42 are inwardly folded to at least partially close the first end 51 in a manner so that compression tabs 25 and 43 are adjacent an upper portion of containers C. When the top end flap 12 and reinforcing end flap 212 are downwardly folded, the proximal portion 221 and the intermediate portion 222 of the reinforcing end flap 212 fold inwardly into the interior 301 of the open-ended sleeve 300 along fold lines 213, 216, 219 to form a shoulder 305 (FIG. 7). FIG. 7 illustrates the interior 301 of the carton 5 with the side panels 20, 40 and side end flaps 22, 42 omitted to more clearly show the configuration of the shoulder 305. Particularly, according to one embodiment, the proximal portion 221 can extend generally downwardly from the central panel 206, and the intermediate portion 222 can extend generally horizontally from the proximal portion 221 to the distal portion 218 and the top end flap 12.

Figure 6A:
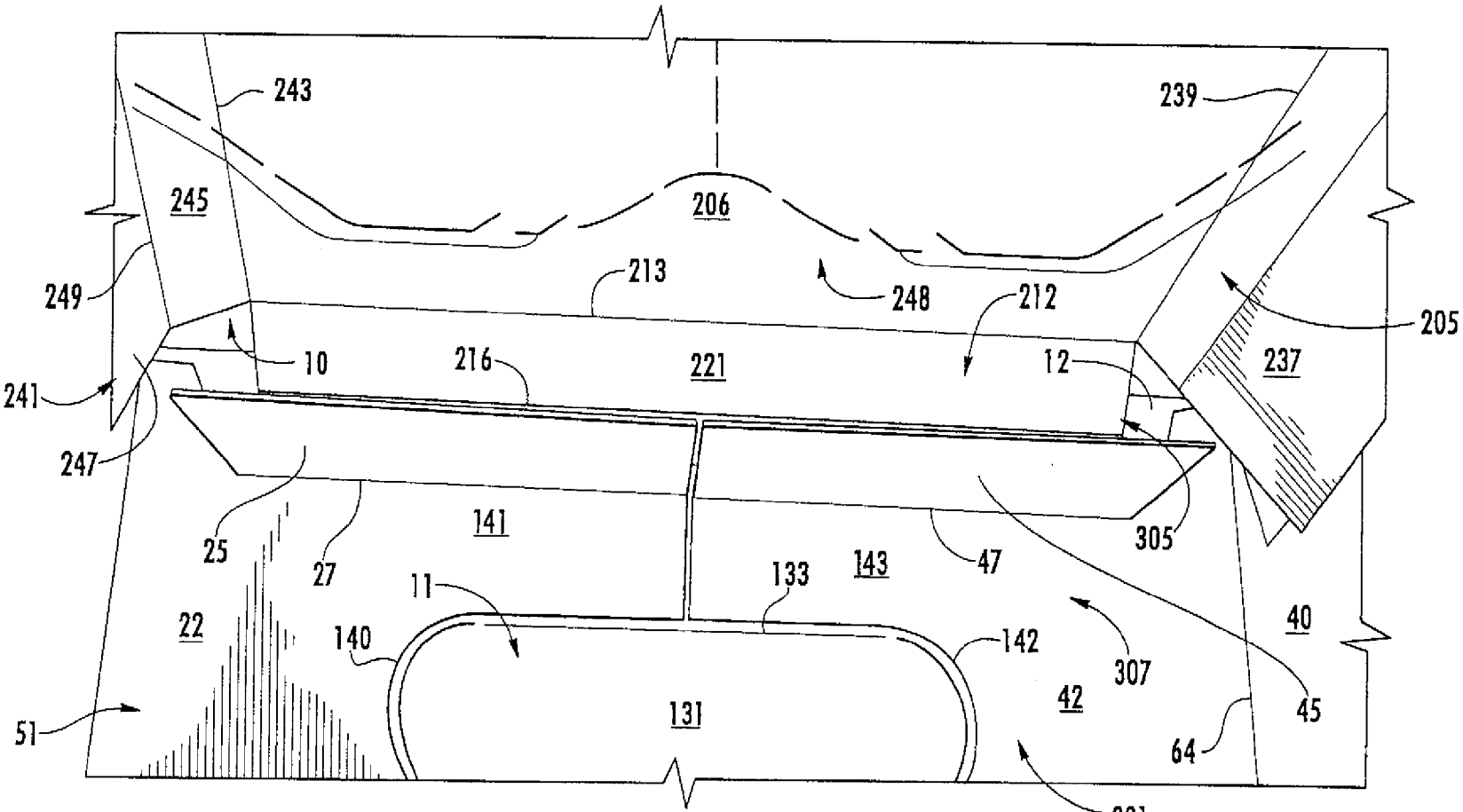
FIGS. 6A and 6B are interior perspective views of respective closed ends of the erected carton according to the exemplary embodiment of the disclosure.
Figure 8:
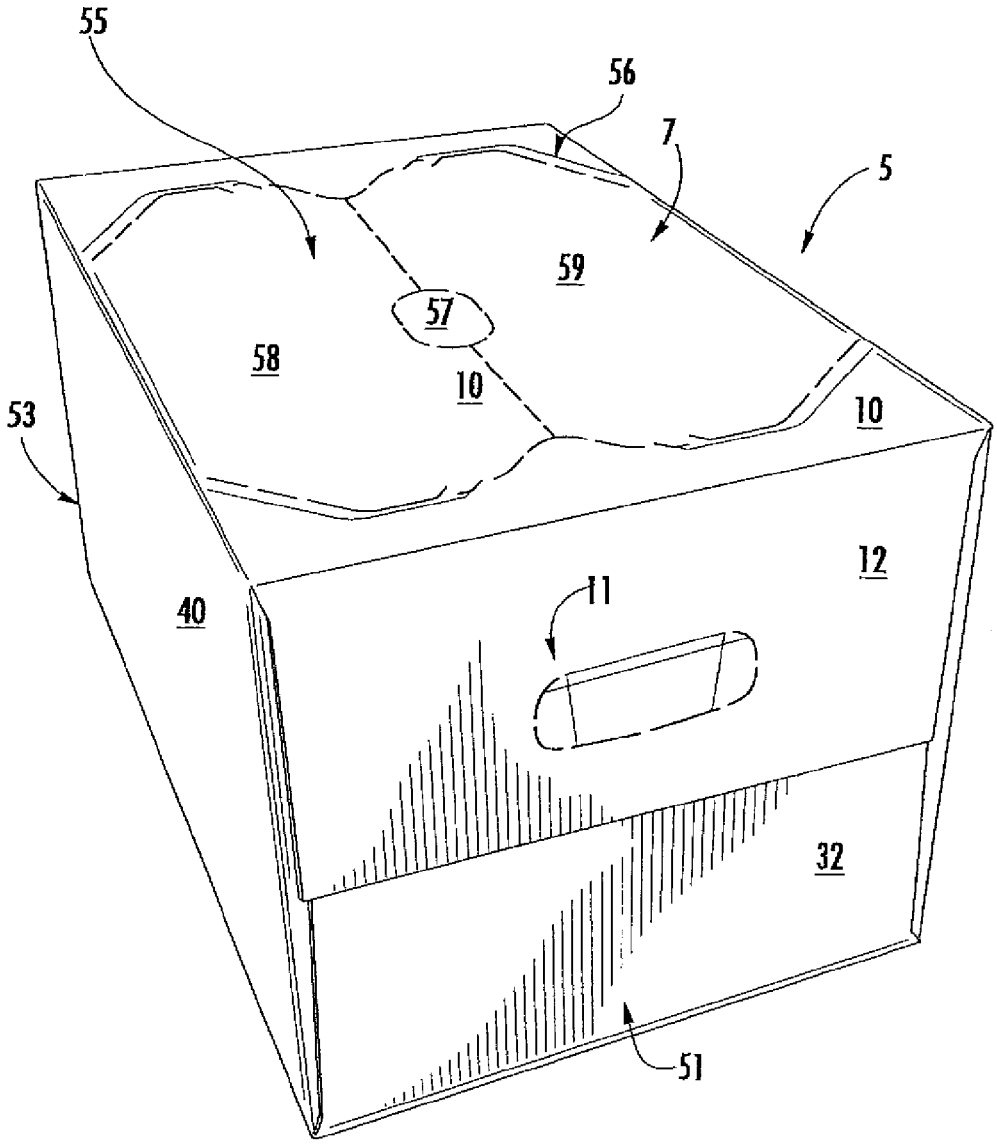
FIG. 8 is a perspective view showing the assembled carton according to the exemplary embodiment of the disclosure.

In the illustrated embodiment, as the reinforcing end flap 212 and the top end flap 12 are downwardly folded, the shoulder 305 contacts the exterior surfaces of the compression tabs 25, 43 to fold the compression tabs along the respective fold lines 27, 47 into the interior space 301 (FIG. 6A). The bottom end flap 32 can be upwardly folded to overlap the side end flaps 22, 42 before or after folding the top end flap 12. Accordingly, the top end flap 12, the reinforcing end flap 212, the side end flaps 22, 42, and the bottom end flap 32 can be selectively adhered to one another to close the first end 51 of the carton 5 (FIGS. 6A and 8). When the end 51 is closed, the cutouts 140, 142 in the respective side end flaps 22, 42 generally line up with the handle flap 131 in the top end flap 12 and the notch 225 in the distal portion 218 of the reinforcing end flap 212 to form the handle 11. The positioning of the compression tabs 25, 43 provide extra reinforcement and improved container retention within carton 5. The shoulder 305 and the inwardly folded compression tabs 25, 43 can help restrict the movement of the upper portions N of the containers C adjacent the first end 51 of the carton. In one embodiment, the shoulder 305 and the compression tabs 25, 43 can contact the upper portions N of the containers C adjacent the first end 51.

Figure 6B:
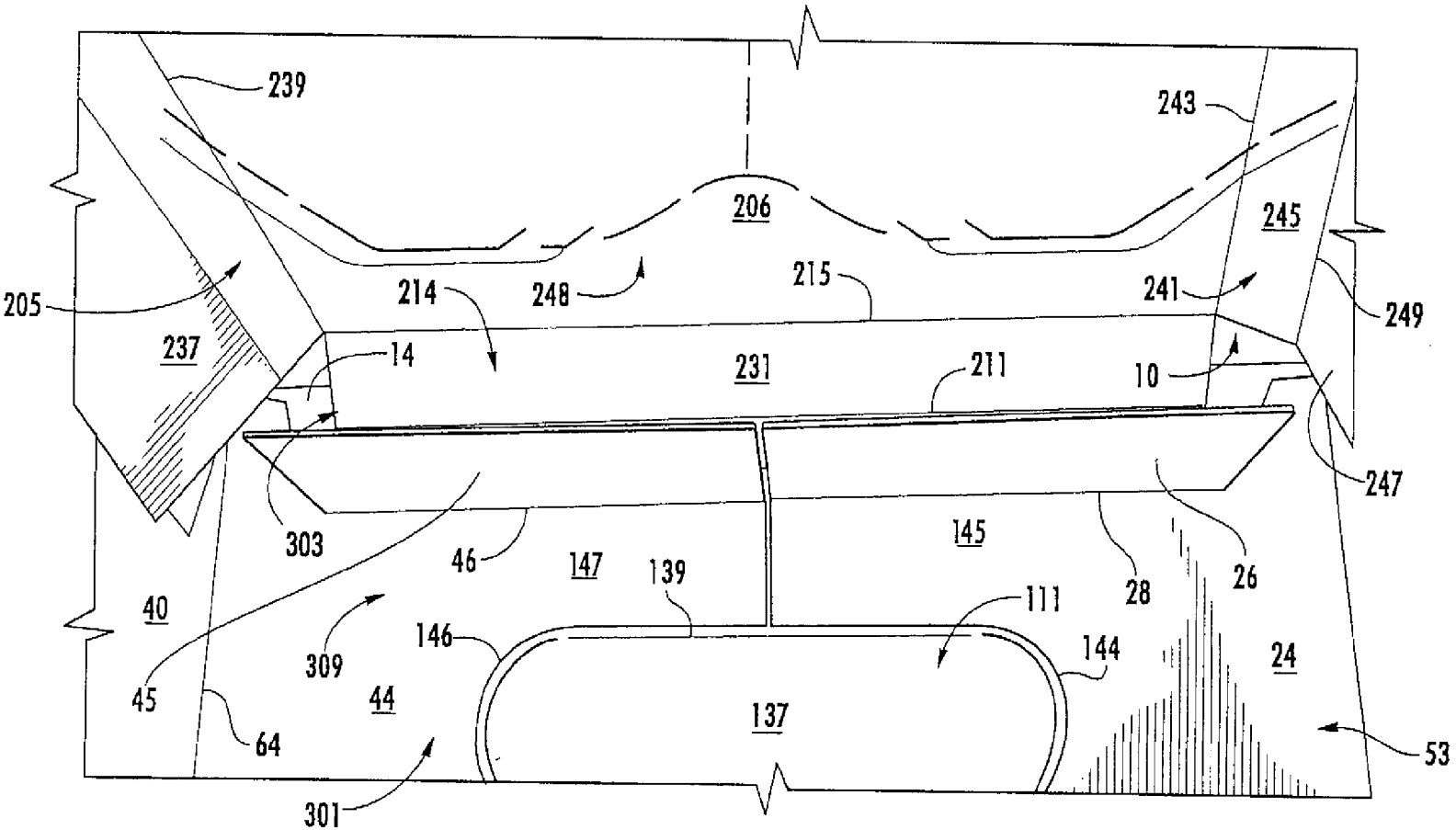

As shown in FIG. 6B, the second end 53 of the carton 5 is closed in a similar manner as the first end 51 by folding and respectively overlapping the side end flaps 24, 44, the bottom end flap 34, the top end flap 14, and the reinforcing end flap 214. The proximal portion 231 and the intermediate portion 232 of the reinforcing end flap 214 form a shoulder 303 as the reinforcing end flap 214 folds downwardly. The shoulder 303 folds the compression tabs 26, 45 of the respective side end flaps 24, 44 inwardly so that compression tabs 26, 45 and the shoulder 303 can help restrict the movement of the upper portions N of the containers C adjacent the second end 53. In one embodiment, the shoulder 305 and the compression tabs 25, 43 can contact the upper portions N of the containers C adjacent the first end 51. The erected carton 5 is shown in FIG. 8. One or both of the ends 51, 53 could be otherwise shaped, arranged, configured, or omitted, without departing from the disclosure. Additionally, the open-ended sleeve 300 can be alternatively closed and loaded with containers without departing from the disclosure. For example, the containers C can be loaded into the open-ended sleeve 300 after closing either end 51, 53.

FIGS. 6A and 6B show the respective closed ends 51, 53 of the carton 5 with the containers C omitted to more clearly show the features of the carton. As shown in FIGS. 6A and 6B, the interior space 301 of the carton 5 is at least partially defined by the shoulders 303, 305 and the inwardly folded compression tabs 26, 45, 25, 43. The interior space 301 is further at least partially defined by the reinforcing side flap 237 and the reinforcing side flap 241, which can help restrict the motion of the upper portions N of the containers C that are adjacent the respective side panels 40, 20. In one embodiment, the reinforcing side flaps 237, 241 can contact the upper portions N of the containers C adjacent the respective side panels 40, 20. Accordingly, the portion of the interior space 301 adjacent the top panel 10 and the central panel 206 generally tapers inwardly from the ends 51, 53 and the side panels 20, 40 to form a tent structure (the shoulders 303, 305, the compression tabs 26, 45, 25, 43, the reinforcing side flap 237, and the reinforcing side flap 241) to help restrain the narrower upper portions N of the containers C in the carton 5 and to help prevent breakage of the containers. The tent structure allows the carton 5 to be generally rectangular on the outside while having tapered corners in the upper portion of the interior space 301. In one embodiment, the tent structure can help reinforce the upper corners of the carton 5.

In one embodiment, the inwardly folded compression tabs 25, 43, 26, 45 can engage an underside of a rim or cap CP of the containers C adjacent the respective ends 51, 53 to further help secure the containers from movement. Additionally, the engagement of the compression tabs 25, 43, 26, 45 against the caps CP can help restrain the side end flaps 22, 42, 24, 44 when the end flaps are selectively glued together when closing the ends 51, 53 of the carton 5. When closing the first end 51, for example, portions of the top end flap 12 can be glued to portions of the side end flaps 22, 42. As the top end flap 12 is pressed against the side end flaps 22, 42 during gluing, the compression tabs 25, 43 can push against the caps CP of the containers C adjacent the end 51 to support the side end flaps 22, 42. Accordingly, the compression tabs 25, 43 allow the compression of glue between the top end flap 12 against the side end flaps 22, 42 by providing a firm base against which the top end flap can be pressed to sufficiently squeeze the glue between the top end flap and the side end flaps. Similarly, the tabs 26, 45 can help support the side end flaps 24, 44 during the compression of glue between the top end flap 14 and side end flaps 24, 44 at the second end 53 of the carton 5.

The handle 11 can be used to grasp the carton 5 by pressing against the elongate handle flap 131 to provide a handle opening in the closed first end 51 of the carton 5. Similarly, the handle 111 can be used to grasp the carton 5 at the closed second end 53. As shown in FIGS. 3, 5, and 7, the distal portions 218, 220 of the respective reinforcing end flaps 212, 214, also provide reinforcement features for the respective handles 11, 111 by providing an extra layer of material above the handles 11, 111. The distal portions 218, 220, the portions of the top end flaps 12, 14 above the respective handle flaps 131, 137, and the upper portions 141, 143, 145, 147 of the respective side end flaps 22, 42, 24, 44 form respective reinforcement portions 307, 309 (FIGS. 6A and 6B) at least above the respective handles 11, 111. Accordingly, the reinforcement portions 307, 309 can be three-ply portions above the respective handles 11, 111. The reinforcing portions 307, 309 also can comprise the respective inwardly folded handle flaps 131, 137 when the respective handle 11, 111 is activated, wherein the handle flaps 131, 137 can be upwardly folded and placed in face-to-face contact with the interior surface of the respective side end flaps 22, 42; 24, 44. The handles 11, 111 could be alternatively, shaped, arranged, configured, and/or reinforced without departing from this disclosure.

The dispenser 7 can be opened by separating the dispenser panel 55 from the top panel 10 to access to the containers C in the carton. The dispenser panel 55 can be adhered to the dispenser panel 250 of the insert blank 203 so that the dispenser panels 55, 250 are upwardly folded together to create a dispenser opening for accessing the containers C. The dispenser panels 55, 250 could be otherwise shaped, arranged, configured, and/or activated, without departing from the disclosure.

As shown in FIG. 8, the side panels 20, 40 of the carton 5 are generally perpendicular to the bottom panel 30 and top panel 10, but the carton could be otherwise shaped without departing from the disclosure. The insert 205 of the carton 5 provides internal bracing of the narrowed upper portions of the containers C at the side panels 20, 40 and ends 51, 53.

The blanks according to the present disclosure can be, for example, formed from coated paperboard and similar materials. For example, the interior and/or exterior sides of the blanks can be coated with a clay coating. The clay coating may then be printed over with product, advertising, price coding, and other information or images. The blanks may then be coated with a varnish to protect any information printed on the blank. The blanks may also be coated with, for example, a moisture barrier layer, on either or both sides of the blank. In accordance with the above-described embodiments, the blanks may be constructed of paperboard of a caliper such that it is heavier and more rigid than ordinary paper. The blanks can also be constructed of other materials, such as cardboard, hard paper, or any other material having properties suitable for enabling the carton to function at least generally as described herein. The blanks can also be laminated or coated with one or more sheet-like materials at selected panels or panel sections.

In accordance with the above-described embodiments of the present disclosure, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed portion in the material along the desired line of weakness; a cut that extends partially into a material along the desired line of weakness, and/or a series of cuts that extend partially into and/or completely through the material along the desired line of weakness; and various combinations of these features.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

The above embodiments may be described as having one or more panels adhered together by glue during erection of the carton embodiments. The term "glue" is intended to encompass all manner of adhesives commonly used to secure carton panels in place.

The foregoing description of the disclosure illustrates and describes various embodiments. As various changes could be made in the above construction without departing from the scope of the disclosure, it is intended that all matter contained in the above description or shown in the accompanying drawings shall be interpreted as illustrative and not in a limiting sense. Furthermore, the scope of the present disclosure covers various modifications, combinations, alterations, etc., of the above-described embodiments that are within the scope of the claims. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carton for holding a plurality of containers, the carton comprising:

a plurality of panels that extends at least partially around an interior of the carton, the plurality of panels comprising a top panel, a bottom panel, a first side panel, and a second side panel;

a plurality of end flaps respectively foldably connected to respective panels of the plurality of panels, the plurality of end flaps being at least partially overlapped with respect to one another to thereby at least partially form a closed end of the carton, the plurality of end flaps comprising a top end flap foldably connected to the top panel;

a reinforcing insert comprising a central panel, a reinforcing end flap, and a reinforcing side flap, the central panel at least partially overlapping the top panel, the reinforcing side flap being foldably connected to the central panel, and the reinforcing end flap comprising a proximal portion foldably connected to the central panel, an intermediate portion foldably connected to the proximal portion, and a distal portion foldably connected to the intermediate portion, wherein the reinforcing end flap at least partially overlaps the top end flap;

wherein the reinforcing end flap at least partially forms a shoulder extending in the interior of the carton, the shoulder comprising a first portion extending generally downwardly from the central panel and a second portion extending from the first portion to the closed end of the carton, the second portion being foldably connected to the first portion along a fold line that is spaced apart from the closed end of the carton.

2. The carton of claim 1, wherein the proximal portion and the intermediate portion at least partially form the respective first portion and second portion of the shoulder in the interior of the carton and the distal portion at least partially overlaps the top end flap.

3. The carton of claim 2, wherein the intermediate portion extends generally horizontally from the proximal portion to the distal portion.

4. The carton of claim 1, further comprising a handle comprising a handle flap extending in the top end flap, wherein at least a portion of the handle is disposed below the reinforcing end flap.

5. The carton of claim 4, wherein:

the distal portion of the reinforcing end flap comprises a free edge;

the handle further comprises a notch defined by at least a portion of the free edge of the distal portion; and at least a portion of the handle flap is generally aligned with the notch.

6. The carton of claim 5, wherein the plurality of end flaps further comprises a first side end flap foldably connected to the first side panel and a second side end flap foldably connected to the second side panel, the first side end flap comprising a first handle cutout and the second side end flap comprising a second handle cutout, each of the first handle cutout and the second handle cutout being generally aligned with at least a portion of the handle flap in the top end flap.

7. The carton of claim 6, wherein the distal portion of the reinforcing end flap is at least partially in face-to-face contact with an interior surface of the top end flap, and the distal portion of the reinforcing end flap is at least partially in face-to-face contact with an exterior surface of each of the first side end flap and the second side end flap.

8. The carton of claim 7, wherein:

the first side end flap comprises a first compression tab and the second side end flap comprises a second compression tab;

each of the first compression tab and the second compression tab extending at least partially into the interior of the carton;

the proximal portion of the reinforcing end flap and the intermediate portion of the reinforcing end flap forming the respective first portion and second portion of the shoulder extending in the interior of the carton; and the shoulder contacts at least a portion of each of the first compression tab and the second compression tab.

9. The carton of claim 1, further comprising a dispenser, the dispenser comprising a first dispenser pattern extending in at least the top panel and a second dispenser pattern extending in at least the central panel, at least a portion of the first dispenser being generally aligned with at least a portion of the second dispenser pattern.

10. The carton of claim 1, wherein the first portion of the shoulder is spaced apart from the closed end of the carton.

11. A carton for holding a plurality of containers, the carton comprising:

a plurality of panels that extends at least partially around an interior of the carton, the plurality of panels comprising a top panel, a bottom panel, a first side panel, and a second side panel;

a plurality of end flaps respectively foldably connected to respective panels of the plurality of panels, the plurality of end flaps being at least partially overlapped with respect to one another to thereby at least partially form a closed end of the carton, the plurality of end flaps comprising a top end flap foldably connected to the top panel;

a reinforcing insert comprising a central panel, a reinforcing end flap, and a reinforcing side flap, the central panel at least partially overlapping the top panel, the reinforcing side flap being foldably connected to the central panel, and the reinforcing end flap being foldably connected to the central panel, wherein the reinforcing end flap at least partially overlaps the top end flap;

wherein the reinforcing end flap comprises a proximal portion foldably connected to the central panel, an intermediate portion foldably connected to the proximal portion, and a distal portion foldably connected to the intermediate portion;

wherein the proximal portion and the intermediate portion at least partially form a shoulder in the interior of the carton and the distal portion at least partially overlaps the top end flap;

wherein the plurality of end flaps further comprises a side end flap foldably connected to the first side panel, the side end flap comprising a compression tab that is foldable about a fold line extending in the side end flap, at least a portion of the shoulder contacting at least a portion of the compression tab.

12. The carton of claim 11, wherein the fold line connecting the compression tab to the side end flap is a generally lateral fold line, the compression tab extends at least partially into the interior of the carton from the fold line, and at least a portion of the shoulder contacts at least a portion of an exterior surface of the compression tab.

13. The carton of claim 12, wherein the compression tab contacts at least one container disposed in the interior of the carton.

14. The carton of claim 12, further comprising a handle comprising a handle flap extending in the top end flap and a handle cutout extending in at least the side end flap, wherein the handle cutout is generally aligned with the handle flap, and at least a portion of the handle cutout is disposed below the distal portion of the reinforcing end flap.

15. The carton of claim 12, wherein:

the side end flap is a first side end flap and the compression tab is a first compression tab;

the plurality of end flaps further comprises a second side end flap foldably connected to the second side panel, the second side end flap comprising a second compression tab that is foldable about a fold line extending in the second side end flap; and the second compression tab extends at least partially into the interior of the carton from the fold line, and at least a portion of the shoulder contacts at least a portion of an exterior surface of the second compression tab.

16. In combination, a carton blank and a reinforcing insert for forming a carton for holding a plurality of containers, the carton blank comprising:

a plurality of panels comprising a top panel, a bottom panel, a first side panel, and a second side panel;

a plurality of end flaps respectively foldably connected to respective panels of the plurality of panels for at least partially overlapping with respect to one another to at least partially close an end of the carton formed from the carton blank, the plurality of end flaps comprising a top end flap foldably connected to the top panel;

the reinforcing insert comprising:

a central panel at least partially overlapping the top panel;

a reinforcing end flap foldably connected to the central panel, the reinforcing end flap at least partially overlaps the top end flap, wherein the reinforcing end flap comprises a proximal portion foldably connected to the central panel, an intermediate portion foldably connected to the proximal portion, and a distal portion foldably connected to the intermediate portion; and a reinforcing side flap foldably connected to the central panel.

17. The combination of claim 16, wherein the proximal portion and the intermediate portion are for at least partially forming a shoulder in the interior of the carton formed from the carton blank and the reinforcing insert and the distal portion at least partially overlaps the top end flap.

18. The combination of claim 16, wherein the top end flap is foldably connected to the top panel along a first longitudinal fold line, the reinforcing end flap is foldably connected to the central panel along a second longitudinal fold line, and the second longitudinal fold line is spaced apart from the first longitudinal fold line, the second longitudinal fold line at least partially overlaying the top panel.

19. The combination of claim 18, wherein the proximal portion of the reinforcing end flap is foldably connected to the central panel at the second longitudinal fold line, the intermediate portion is foldably connected to the proximal portion along a third longitudinal fold line, and the distal portion is foldably connected to the intermediate portion along a fourth longitudinal fold line, the proximal portion and the intermediate portion being free to fold along the second longitudinal fold line, the third longitudinal fold line, and the fourth longitudinal fold line away from the top panel and the top end flap.

20. The combination of claim 16, wherein the plurality of end flaps further comprises a side end flap foldably connected to the first side panel, the side end flap comprising a compression tab that is foldable about a lateral fold line extending in the side end flap.

21. The combination of claim 16, further comprising handle features comprising a handle flap that is at least partially defined by a cut line extending in the top end flap, wherein at least a portion of the cut line is spaced apart from the distal portion of the reinforcing end flap.

22. The combination of claim 21, wherein:

the distal portion of the reinforcing end flap comprises a free edge;

the handle further comprises a notch defined by at least a portion of the free edge of the distal portion; and at least a portion of the handle flap is generally aligned with the notch.

23. The combination of claim 17, wherein the proximal portion is for being spaced apart from the closed end of the carton formed from the carton blank and the reinforcing insert.

24. A method of forming a carton comprising:

obtaining a carton blank comprising a plurality of panels comprising a top panel, a bottom panel, a first side panel, and a second side panel, a plurality of end flaps respectively foldably connected to respective panels of the plurality of panels, the plurality of end flaps comprising a top end flap foldably connected to the top panel;

obtaining a reinforcing insert comprising a central panel, a reinforcing end flap, and a reinforcing side flap foldably connected to the central panel, the reinforcing end flap comprising a proximal portion foldably connected to the central panel, an intermediate portion foldably connected to the proximal portion, and a distal portion foldably connected to the intermediate portion;

positioning the reinforcing insert relative to the carton blank so that the central panel at least partially overlaps the top panel and the reinforcing insert at least partially overlaps the top end flap;

forming an interior of the carton at least partially defined by the plurality of panels, the forming the interior of the carton comprising forming an open-ended sleeve;

positioning the plurality of end flaps and the reinforcing end flap to at least partially close an end of the open-ended sleeve and to at least partially form a shoulder in the reinforcing end flap, the shoulder extending in the interior of the carton and comprising a first portion extending generally downwardly from the central panel and a second portion extending from the first portion to the closed end of the carton, the second portion being foldably connected to the first portion along a fold line that is spaced apart from the closed end of the carton.

25. The method of claim 24, wherein the positioning the plurality of end flaps and the reinforcing end flap comprises folding the proximal portion and the intermediate portion of the reinforcing end flap at least partially into the interior of the carton to form the respective first portion and second portion of the shoulder, the intermediate portion extending generally horizontally from the proximal portion to the distal portion.

26. The method of claim 24, wherein the positioning the plurality of end flaps and the reinforcing end flap comprises positioning the first portion of the shoulder to be spaced apart from the closed end of the carton.

27. A method of forming a carton comprising:

obtaining a carton blank comprising a plurality of panels comprising a top panel, a bottom panel, a first side panel, and a second side panel, a plurality of end flaps respectively foldably connected to respective panels of the plurality of panels, the plurality of end flaps comprising a top end flap foldably connected to the top panel;

obtaining a reinforcing insert comprising a central panel, a reinforcing end flap, and a reinforcing side flap foldably connected to the central panel, the reinforcing end flap being foldably connected to the central panel;

positioning the reinforcing insert relative to the carton blank so that the central panel at least partially overlaps the top panel and the reinforcing insert at least partially overlaps the top end flap;

forming an interior of the carton at least partially defined by the plurality of panels, the forming the interior of the carton comprising forming an open-ended sleeve;

positioning the plurality of end flaps and the reinforcing end flap to at least partially close an end of the open-ended sleeve wherein the reinforcing end flap comprises a proximal portion foldably connected to the central panel, an intermediate portion foldably connected to the proximal portion, and a distal portion foldably connected to the intermediate portion, and the positioning the plurality of end flaps and the reinforcing end flap comprises folding the proximal portion and the intermediate portion of the reinforcing end flap at least partially into the interior of the carton to form a shoulder, the proximal portion extending generally downwardly from the top panel and the intermediate portion extending generally horizontally from the proximal portion to the distal portion;

wherein the plurality of end flaps further comprises a side end flap foldably connected to the first side panel, the side end flap comprising a compression tab that is foldable about a fold line extending in the side end flap; and wherein the folding the proximal portion and the intermediate portion of the reinforcing end flap comprises folding the compression tab at least partially into the interior of the carton, at least a portion of the shoulder contacting at least a portion of the compression tab.

28. The method of claim 27, further comprising loading a plurality of containers into the interior of the carton, wherein:

the folding the compression tab comprises pivoting the compression tab at least partially into the interior of the carton to contact at least one container of the plurality of containers;

the positioning the plurality of end flaps and the reinforcing end flap comprises gluing at least a portion of the top end flap to an exterior surface of at least a portion of the side end flap and pressing the top end flap against the side panel toward the interior of the carton; and the compression tab contacting the at least one container supports the side end flap against the pressing of the top end flap.

29. The method of claim 28, wherein:

the carton blank further comprises a handle flap extending in the top end flap and a handle cutout extending in the side end flap;

the distal portion of the reinforcing end flap comprises a free edge, at least a portion of the free edge defining a notch that is generally aligned with at least a portion of the handle flap;

the positioning the plurality of end flaps and the reinforcing end flap further comprises aligning the handle cutout with at least a portion of the handle flap and at least a portion of the notch to form a handle in the closed end of the carton; and at least a portion of each of the handle flap and the handle cutout is disposed below the distal portion of the reinforcing end flap in the closed end of the carton.

* * * * *